US006338172B1

(12) United States Patent
Taylor et al.

(10) Patent No.: US 6,338,172 B1
(45) **Date of Patent: *Jan. 15, 2002**

(54) POLYMERIC LENGTH AND WIDTH ADJUSTABLE BED FRAME SYSTEM

(75) Inventors: Harry A. Taylor, Knoxville, TN (US); T. Michael Rusher, Salisbury, NC (US)

(73) Assignee: Harry A. Taylor, et al., Knoxville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/414,248

(22) Filed: Oct. 7, 1999

Related U.S. Application Data

(63) Continuation-in-part of application No. 08/950,960, filed on Oct. 15, 1997, now Pat. No. 5,996,145.

(51) Int. Cl.[7] ..... A47C 19/04

(52) U.S. Cl. ..... 5/200.1; 5/184; 5/185; 5/202; 5/286

(58) Field of Search ..... 5/181, 184, 185, 5/200.1, 201, 202, 282.1, 285, 286, 236.1, 238, 131, 132, 288, 304

(56) References Cited

U.S. PATENT DOCUMENTS

| | | | | |
|---|---|---|---|---|
| 402,129 A | | 4/1889 | Beckert | |
| 593,824 A | | 11/1897 | Tinkham | |
| 620,591 A | | 3/1899 | Jackson, Jr. | |
| 985,355 A | | 2/1911 | Lockhart | |
| 1,080,577 A | | 12/1913 | Pascale et al. | |
| 1,323,257 A | | 12/1919 | Dudek | |
| 1,383,907 A | | 7/1921 | Corer | |
| 1,504,807 A | | 8/1924 | Brotherton, Jr. et al. | |
| 1,669,625 A | | 5/1928 | Oppenheim | |
| 2,452,808 A | | 11/1948 | Tucker | 5/209 |
| 2,539,933 A | | 1/1951 | Silverman | 5/296 |
| 2,550,224 A | | 4/1951 | Clerc | 5/149 |
| 2,611,907 A | | 9/1952 | Clerc | 5/176 |
| 2,666,931 A | | 1/1954 | Clerc | 5/181 |
| 2,771,616 A | | 11/1956 | Duncan | 5/286 |
| 2,799,868 A | * | 7/1957 | Sands | 5/132 |
| 2,842,782 A | * | 7/1958 | Sands | 5/132 X |
| 2,886,832 A | | 5/1959 | Mitchell et al. | 5/236 |
| 2,960,701 A | | 11/1960 | Nawara | 5/181 |
| 3,031,689 A | | 5/1962 | Sark | 5/310 |
| 3,161,894 A | | 12/1964 | Short | 5/296 |
| 3,188,664 A | | 6/1965 | Goldberg | 5/282 |
| 3,226,736 A | | 1/1966 | Krieger | 5/296 |
| 3,646,623 A | | 3/1972 | Harris et al. | 5/181 |
| 3,710,405 A | | 1/1973 | Watts | 5/201 |
| 3,748,668 A | * | 7/1973 | Rudin | 5/131 |
| 3,828,376 A | | 8/1974 | Miller | 5/200 |
| 3,984,884 A | | 10/1976 | Spitz | 5/176 |

(List continued on next page.)

OTHER PUBLICATIONS

Rid–Gid Glide; date believed to be 1999.

*Primary Examiner*—Michael F. Trettel
(74) *Attorney, Agent, or Firm*—Womble Carlyle Sandridge & Rice, PLLC; C. Robert Rhodes

(57) ABSTRACT

An all polymeric bed frame including opposing laterally spaced apart, elongated side rails, each of the side rails having first and second ends and comprised of a substantially vertical wall and a horizontal support ledge extending laterally from a lower edge of the substantially vertical wall. The bed frame further includes an end cap positioned at least one of the side rail first or second ends, with end caps adapted for connection to a conventional bed headboard. The end cap is positioned substantially perpendicular to the longitudinal dimension of the side rails. The bed frame further includes at least two spaced apart slats attached to the horizontal support members between said side rail first and second ends. The said side rails and the said two slats are comprised of a polymeric material selected from the group consisting of polyethylene, polyethylene copolymers, polypropylene, and acrylonitrile butadiene styrene.

38 Claims, 6 Drawing Sheets

U.S. PATENT DOCUMENTS

| | | | | | |
|---|---|---|---|---|---|
| 4,027,343 | A | | 6/1977 | Hooker | 5/200 |
| 4,038,710 | A | | 8/1977 | Tambascio | 5/200 |
| 4,224,786 | A | | 9/1980 | Langlie et al. | 56/400 |
| 4,263,683 | A | | 4/1981 | Knoke | 5/200 |
| 4,319,370 | A | * | 3/1982 | Robinson | 5/201 |
| 4,361,930 | A | | 12/1982 | Seesengood | 16/38 |
| 4,428,086 | A | * | 1/1984 | Harris | 5/286 |
| 4,646,371 | A | | 3/1987 | Nowell | 5/200 |
| 4,679,261 | A | | 7/1987 | Stanley et al. | 5/183 |
| 4,729,136 | A | | 3/1988 | Santo | 5/201 |
| 4,937,905 | A | | 7/1990 | Thaxton, Jr. | 5/508 |
| 5,038,429 | A | | 8/1991 | Elmalek et al. | 5/236 |
| 5,392,475 | A | | 2/1995 | McCall et al. | 5/18.1 |
| 5,758,372 | A | | 6/1998 | Lopez Diaz | 5/200 |
| 5,815,860 | A | | 10/1998 | Mitchell | 5/236.1 |
| 5,996,145 | A | * | 12/1999 | Taylor | 5/184 |

* cited by examiner

POLYMERIC LENGTH AND WIDTH ADJUSTABLE BED FRAME SYSTEM

RELATED APPLICATIONS

This application is a continuation-in-part of application Ser. No. 08/950,960, filed Oct. 15, 1997, now U.S. Pat. No. 5,996,145 the content of which is incorporated herein by reference.

FIELD OF THE INVENTION

The present invention is related to bed supports, and, more particularly, to an all polymeric adjustable bed frame system.

BACKGROUND OF THE INVENTION

Conventional beds that consist of a mattress and box springs are commonly supported by a bed support consisting of two longitudinal bed rails attached to the corner posts of a headboard or extending between the corner posts of a footboard and a headboard to support the box springs from both lateral sides. Each bed rail is typically an elongated angle member that includes two downwardly directed hooks or fingers or, alternatively, a bracket with attachment holes at each end. In this arrangement, the footboard and headboard actually support the bed rails and therefore the mattress. A plurality of wooden slats generally extend between the side rails for providing additional mattress support.

Conventional bed rails of the type described above are typically formed of stamped metal. Stamped metal bed rails are relatively expensive to manufacture because of the costs of the raw materials (typically steel), the metal forming processes, and a separate painting step. Moreover, the metal bed rails are heavy, substantially increasing the costs of shipping and handling the bed rails. A particular disadvantage in this regard is that known metal bed rails/frame system components cannot be shipped by regular parcel shippers without significant extra cost. Accordingly, when a customer requests a single metal bed frame from a bed retailer, the retailer may well be delayed in his ability to fill the order while he waits for the delivery of a large shipment via common carrier. This situation can cause great customer dissatisfaction.

Mattresses of different sizes (e.g., twin size, full size, queen size, king size, and California king size) have different lengths. Commonly available metal bed rails as described above typically come in a single standard length and cannot easily be adjusted for length. Therefore, a retailer who sells beds of different sizes and wishes to provide bed rails for each such size must carry an inventory bed rails of appropriate length for each bed size. Moreover, even if the corresponding size bed rail is available, it often does not provide a close length fit. In which case a gap may be left between the mattress and the headboard or footboard or, if no footboard is used, the frame may protrude beyond the end of the mattress. Attempts have been made to provide length adjustable bed rails as described in U.S. Pat. No. 1,080,577 to Pascale et al., U.S. Pat. No. 2,539,933 to Silverman, U.S. Pat. No. 3,161,894 to Short, and U.S. Pat. No. 4,679,261 to Stanley et al. However, each of the bed rails disclosed therein suffers from one or more drawbacks in manufacture, assembly, or effectiveness.

Generally, and particularly in the case of larger mattress sizes, transverse slats are provided extending between the bed rails. Typically, the ends of the slats are supported by the flanges of the bed rails which also support the edges of the mattress. The slats are often ¾ inch or more thick. The slat thickness projects upwardly into the mattress so that the mattress is not uniformly supported. As a result, the mattress may be unstable and may have uncomfortable ridges or bulges.

Mattresses of different sizes have different widths. Thus, slats of different lengths are required for different size mattresses. Typically, the provided slats are simply wooden boards which are cut to one of three standard lengths corresponding to the width of the mattress. Attempts have been made to provide length adjustable slats as disclosed in U.S. Pat. No. 1,080,577 to Pascale et al, U.S. Pat. No. 1,504,897 to Brotherton Jr., et al., U.S. Pat. No. 2,452,808 to Tucker, U.S. Pat. No. 2,886,832 to Mitchell, et al., U.S. Pat. No. 3,984,884 to Spitz, and U.S. Pat. No. 4,679,261 to Stanley, et al. Each of these slat designs suffer from one or more drawbacks in manufacture, installation, or use.

Another problem encountered by bed retailers is the growing popularity of California king size mattresses. California king size mattresses are 4 inches longer and 6 inches narrower than conventional king size mattresses. Because the mounting slots of the headboard and footboard of a king size bed are typically preformed to fit a standard king size mattress, conventional bed rails do not properly fit the California king size mattress.

Yet another problem encountered by consumers who purchase beds relates to the step of bolting bed frames side rails to headboards and footboards. Metal bed frame side rails typically are provided with mounting brackets that include two horizontal slots that ideally have a spacing of 2.5 inches center line to center line. Moreover, the lower of the two slots should be positioned approximately 5.5 inches above the floor. These guidelines have been established by the International Sleep Products Association (ISPA) in its Sleep Products Voluntary Dimensional Guideline. Nevertheless, our study of a large number of headboards indicates that the borings or threaded studs provided in wooden headboard vary considerably from these standard dimensions. As a result, it can be very difficult to align a metal bed frame side rail to the corresponding mounting position on even a industry accepted "standard" wooden headboard or footboard.

Thus, there is a need for a bed frame system having bed rails which are cost effectively manufactured, shipped and inventoried. Further, the bed rail should have relatively light weight components sized to be shipped by known parcel shippers.

There is a need for a bed rail which is conveniently length adjustable and which also provides effective and substantially uniform support for a mattress. In particular, there exists a need for a bed frame system which may be assembled to custom fit and support mattresses of substantially all commonly available sizes. This bed frame should be conveniently assembled without the need for tools.

Further, there exists a need for a bed rail which allows the provision of transverse support slats but which reduces or eliminates the irregularities in mattress support caused by the thickness of the slats used on known metal bed frames.

SUMMARY OF THE INVENTION

The present invention is generally directed to a bed frame system that provides a number of advantages over known metal bed frames. The bed frame system includes the characteristic of being length and width adjustable so as to properly support a variety of mattress sizes using a small number of components. No component exceeds 48 inches in length. The present invention is further generally directed to bed support devices, including length adjustable bed rails and length adjustable bed slats, which are formed substantially of polymeric material. Bed frames and components thereof according to the present invention may be cost-effectively manufactured and provide substantial savings in weight. They offer more options for shipment to the customer.

The present invention relates to an all polymeric bed frame, comprising opposing laterally spaced apart, elongated side rails, each of the side rails having first and second ends and comprised of a substantially vertical wall and a horizontal support ledge extending laterally from a lower edge of said substantially vertical wall; an end cap positioned at least one of the side rail first or second ends, the end caps being adapted for connection to a conventional bed headboard, and being positioned substantially perpendicular to the longitudinal dimension of the side rails; at least two spaced apart slats attached to the horizontal support members between the side rail first and second ends. The side rails and the at least two slats are comprised of a polymeric material selected from the group consisting of polyethylene, polyethylene copolymers, polypropylene, and acrylonitrile butadiene styrene.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed. The accompanying drawings, which are incorporated in and constitute a part of this specification, illustrate one embodiment of the invention and, together with the description, serve to explain the principles of the invention.

BRIEF DESCRIPTION OF THE DRAWINGS

The above and other objects, features, and advantages of the present invention will be more clearly understood from the following detailed description taken in conjunction with the accompanying drawings, in which.

DESCRIPTION OF THE PREFERRED EMBODIMENT

Figure 1:
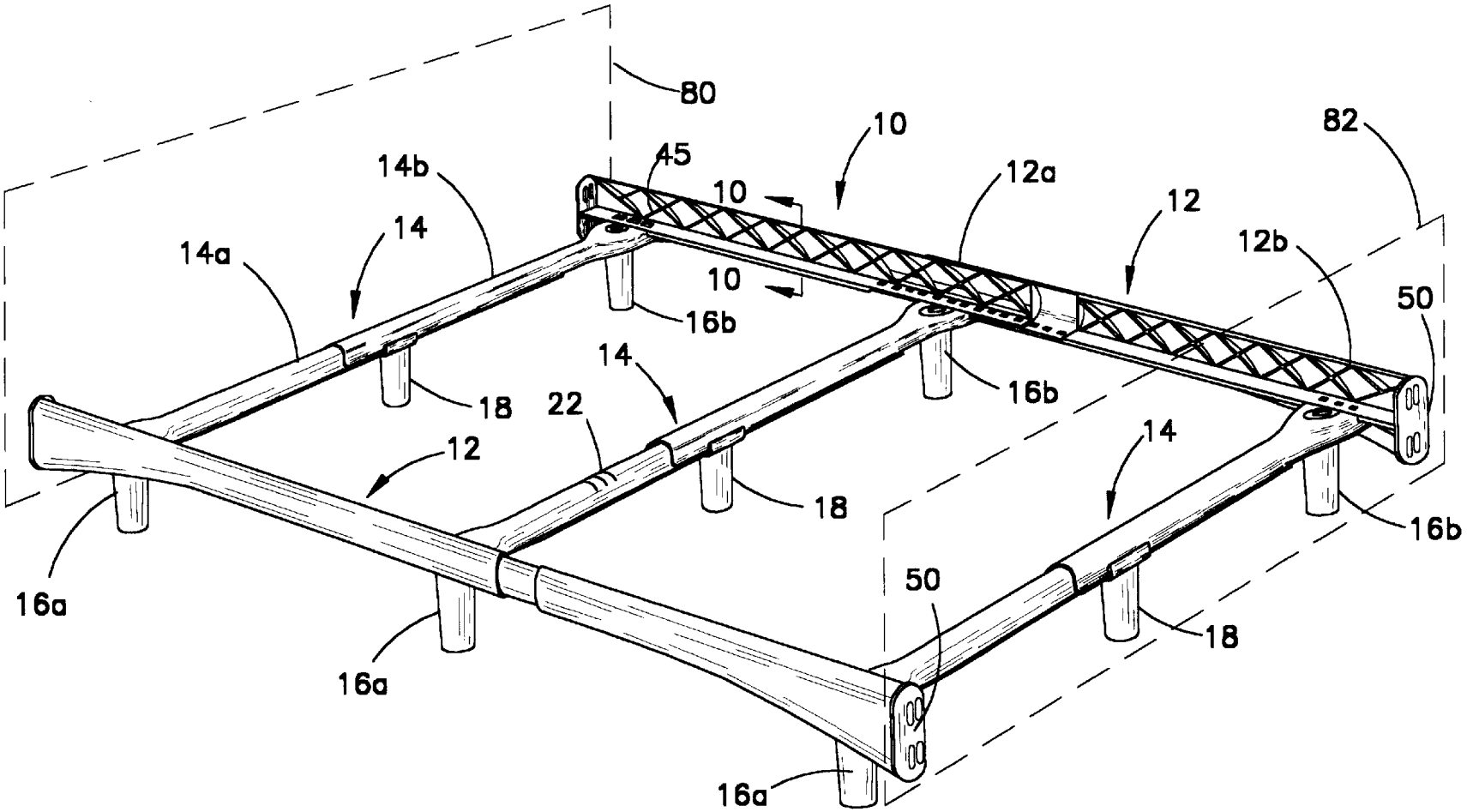
FIG. 1 is an isometric view of the bed frame system of the present invention.

Referring to FIG. 1, the polymeric length and width adjustable bed frame according to the present invention, indicated generally at 10, includes opposing laterally spaced apart, elongated side rails 12 having first and second ends. Each side rail 12 has end cap 50 which permits attachment to a standard headboard. The bed frame further includes at least two spaced apart slats 14 secured at opposing ends thereof to the side rails 12. In a preferred embodiment three slats 14 are provided. The side rails 12 and the slats 14 are length adjustable. It will be appreciated that adjusting the length of the slats 14 also adjusts the width of the bed frame 10.

Referring now to FIGS. 1,6, and 10–12, each length adjustable side rail 12 is comprised of a male member 12*a* and a female member 12*b*. The male member 12*a* is comprised of a substantially vertical wall 40 and an integrally formed horizontal support ledge 42 that extends laterally from a lower edge of the first side of the vertical wall 40. The horizontal support ledge is provided with a plurality of fastener openings 46 which, as is illustrated in FIG. 1, are provided in spaced apart groups. The male member vertical wall 40 has a curvilinear shape in this preferred embodiment and may be provided with a serious of stiffening members 45 for structural rigidity. Given the all polymeric construction of the bed frame 10, the curved shape also serves to enhance the structural rigidity and load bearing capability of the bed frame. Other shapes may be used as desired as will be readily appreciated by one of ordinary skill.

Figure 3:
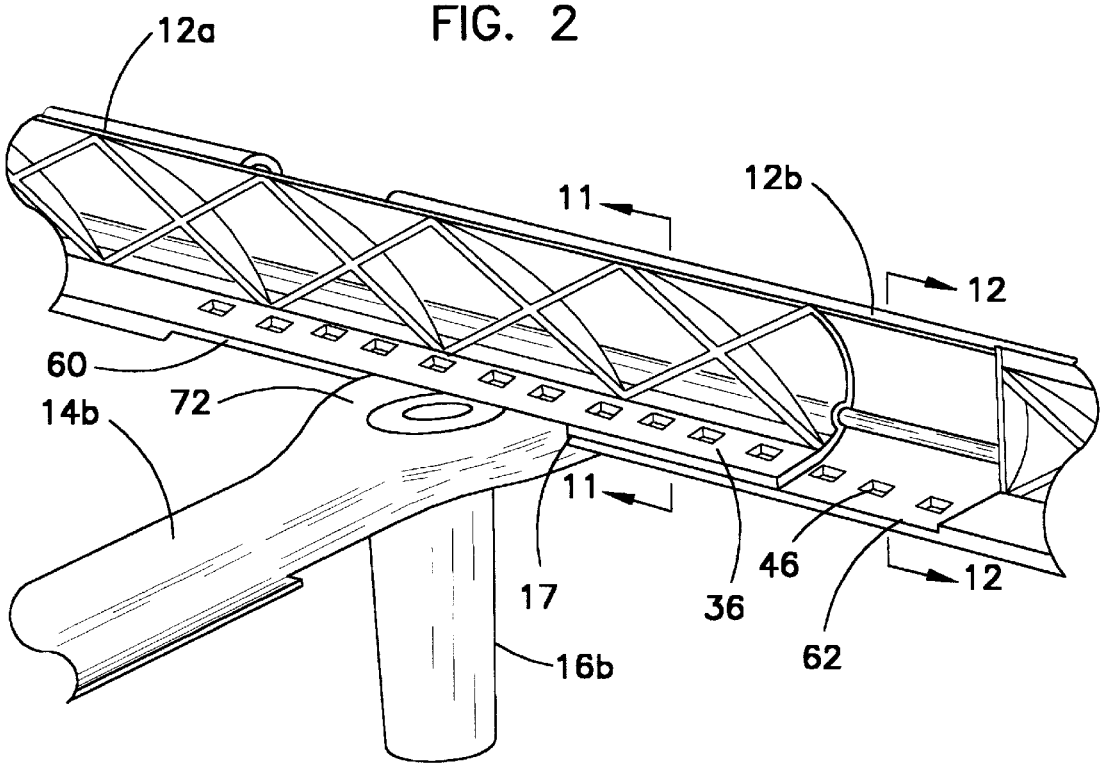
FIG. 3 is a perspective view showing the details of the connection of a length adjustable slat according to the present invention to the male and female members making up the side rail of the present invention.

The male member further includes an inwardly offset mating section 60 positioned at one end thereof (See FIG. 3). As best illustrated in the exploded cross sectional view of FIG. 11, the portion of the vertical wall 401 in the mating section 60 has a wall thickness less than that at a point outside the mating section. In a preferred embodiment, the wall portion 41 in the mating section has a thickness of about half that shown in FIG. 10. The wall portion 41 is recessed so as to be offset inwardly from the outside edge of the vertical wall 40. This recess 43 is continued into the horizontal support ledge 42. A longitudinal alignment slot 44 extends along the length of the mating section in the recessed portion 43 of the substantially vertical wall 41. It should be noted that, in a preferred embodiment, one of the groups of fastener openings is located in the reduced thickness, offset region 60 of the horizontal support ledge 42. As will be explained in more detail below, this recessed portion permits the male member 12*a* to be received by the female member 12*b* while maintaining the outside edges and the horizontal support ledges 32,42 of each of those members in coplanar alignment.

Referring again to FIG. 3, the female member 12*b* includes a outwardly offset mating section 62 for receiving the male member mating section. A cross sectional view of this mating section taken along 12—12 in FIG. 1 and looking towards the end of the bed frame 10 is illustrated in FIG. 12. It will be appreciated that, because this view is taken looking towards the end of the bed frame 10, the orientation of the horizontal support ledge 32 is reversed from that shown in FIG. 11. The female side rail member 12*b* includes a substantially vertical wall 30 and a horizontal support ledge 32, which extends from a lower edge of a first side of the substantially vertical wall 30. In a preferred embodiment, the female member vertical wall 30 has a curvilinear shape. Similar to the male member, the thickness of the portion 31 of the vertical wall 30 located in the outwardly offset mating section 62 is less than, and preferably, about half that in the remainder of the female member. This portion 31 is recessed and thus offset from the inside edge of the female member. The thickness of the horizontal support ledge 32 is similarly reduced in thickness and is similarly offset. The horizontal support ledge 32 includes a plurality of fastener openings 36 positioned in spaced apart groups along the length of the support ledge 32. Preferably, one of these groups of fastener openings 36 is contained in the outwardly offset portion 31 of the female member 12*b*. A longitudinal alignment rib 34 projects laterally from the first side of vertical wall 30 and extends along the length of the inwardly offset wall portion 31. The female member vertical wall 30 may further be provided with stiffening members 35 to provide additional strength and stability to the bed frame. In this embodiment these members are formed as side-by-side, X-shaped members. It will be appreciated that any suitable design of stiffening member may be used and that many different approaches may be taken to their design so long as the function of increasing the overall load carrying ability of the side rails 12 is met.

The offset mating sections 60,62 are positioned at one end of each of the male and female members 12*a*, 12*b* and have a length about 12 and about 20 inches. Thus, up to about 20 inches of the length of the male member 12*a* will be received by about 20 inches of the length of the female member 12*b*.

Figure 6:
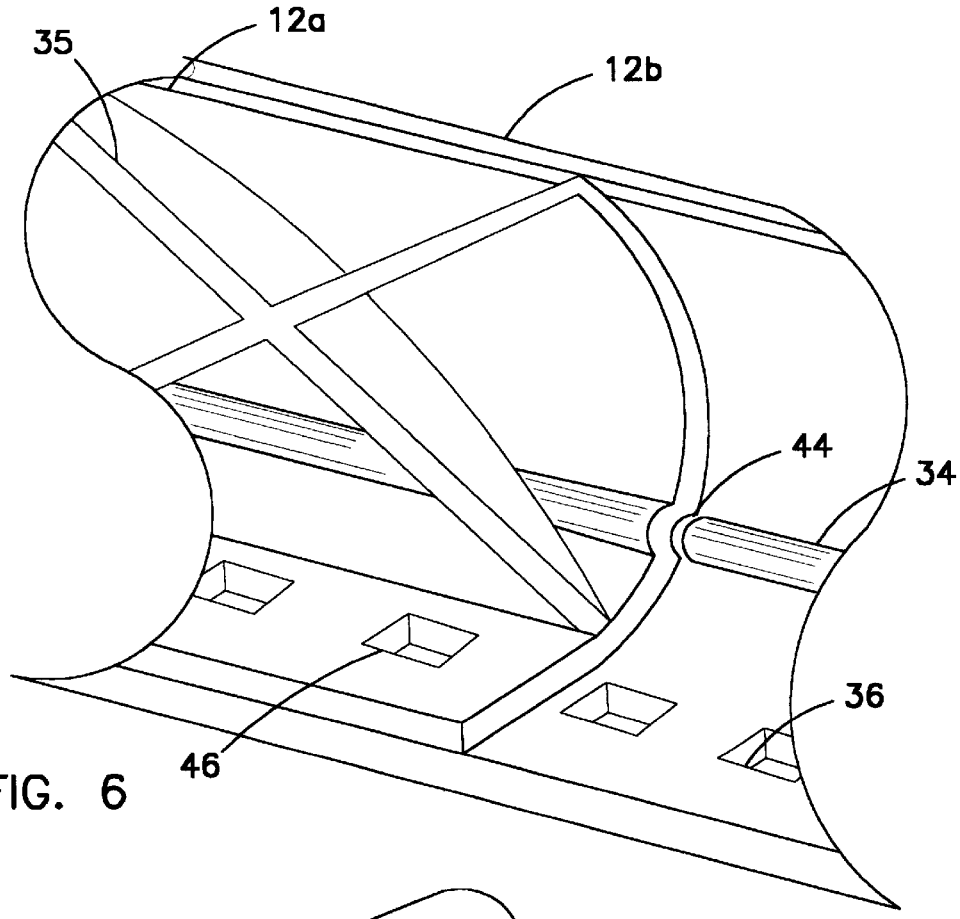
FIG. 6 is an isometric view of the male and female side rail members of the present invention showing the interaction between the female member alignment rail and the male members alignment slot.
Figure 11:
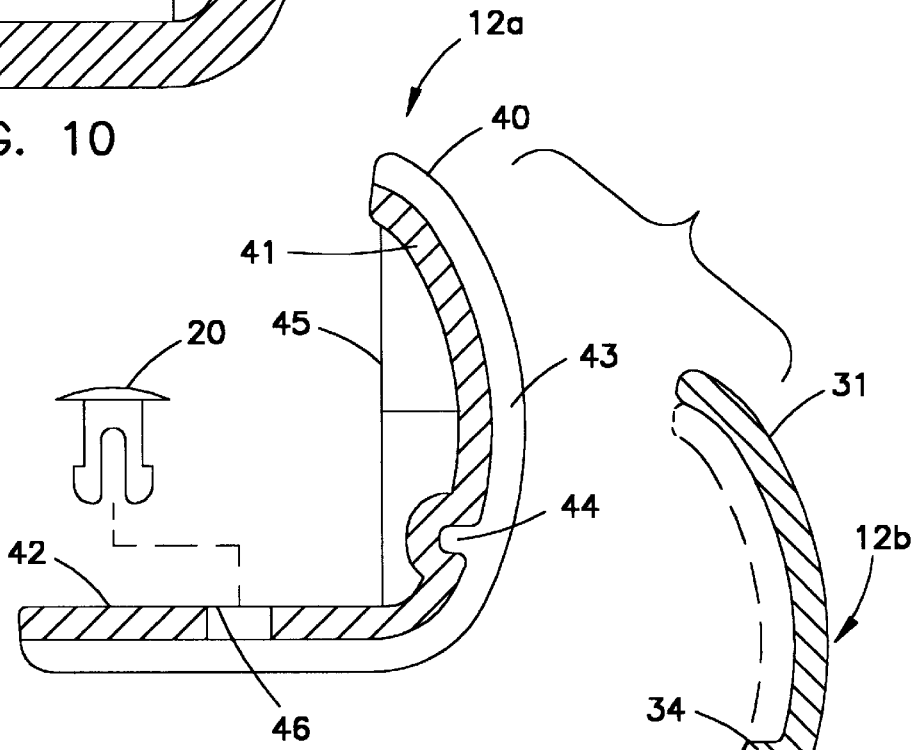
FIG. 11 is an exploded sectional view taken along line 11—11 in FIG. 3.
Figure 12:
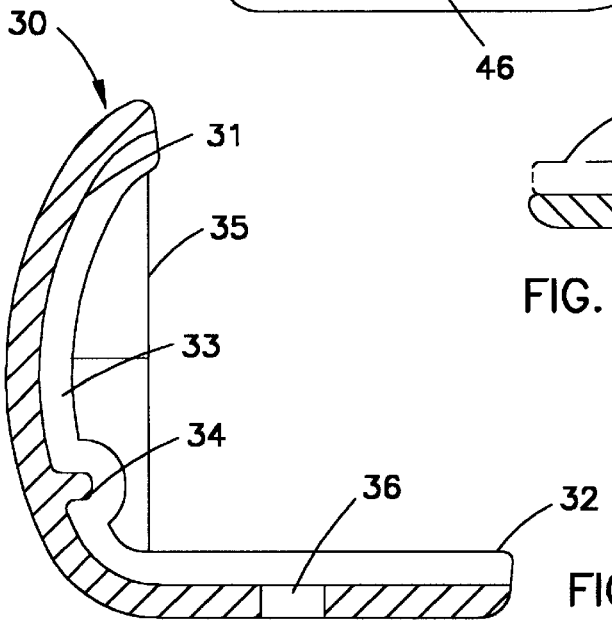
FIG. 12 is a sectional view taken along line 12—12 in FIG. 3.

The cooperation of the male and female side rail members 12*a*, 12*b* is illustrated in FIGS. 3, 6 and 11. The male and female members are brought together such that the inwardly offset mating section 60 of the male member is received in the outwardly offset mating section 62 of the female member. Thus, female member alignment rib 34 engages with the male member alignment slot 44 so as to increase the stability and promote the proper alignment of the two side rail members 12*a*, 12*b*. The recessed portion of the male member horizontal support ledge 32 will rest on the recessed portion of the female member horizontal support ledge 42 so as to align the fastener openings 46,36. It will be readily appreciated that, given the cooperating nature of each recessed portion 31, 41 the horizontal ledges 32, 42 of the female and male side rail members will be substantially coplanar. This feature is an advantage over prior art metal bed frames using wooden slats positioned on metal angle iron frames. A near continuous, one level support surface is provided along the entire length of each side rail. No portion of the side rail extends above the level of the horizontal support ledges 32, 42.

The male and female members may be adjusted to a desired length by sliding the male and female members so as to lengthen or shorten the side rails 12 as desired. It will be appreciated that a number of different bed rail lengths may be created through such adjustment. Desirably, male and female side rail members having a length of about 48 inches can be used to adjust the side rail length from about 75 inches to about 84 inches so as to accommodate mattresses in sizes ranging from twin to king.

Figure 2:
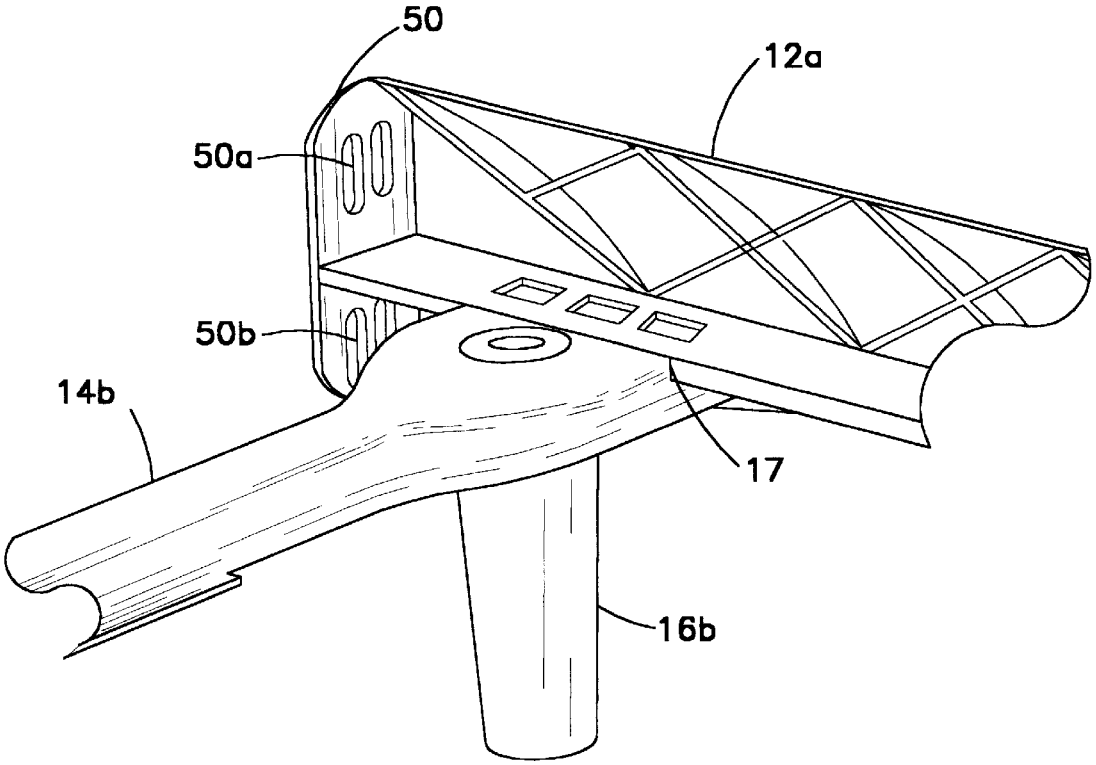
FIG. 2 is a perspective view of the detail of the connection of a length adjustable slat according to the present invention to the side rail of the bed frame of the present invention.
Figure 4:
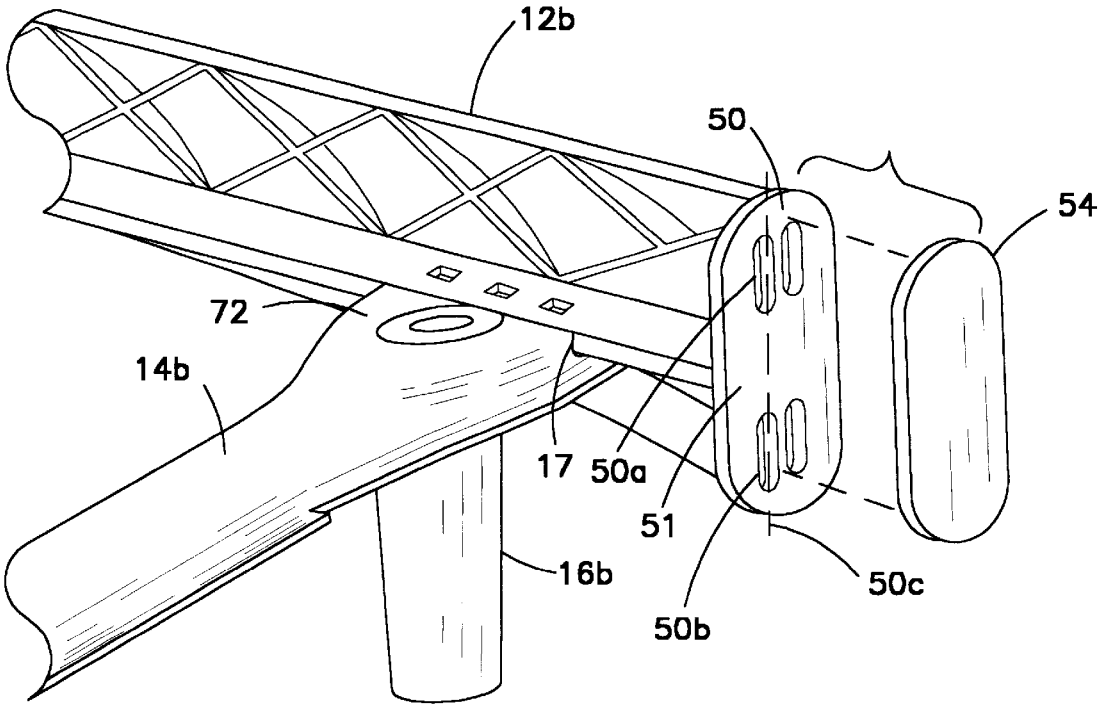
FIG. 4 is a perspective view of the details of the connection of a length adjustable slat according to the present invention to an opposing end of the side rail of the present invention from that shown in FIG. 2.

In a preferred embodiment each of the side rails 12 includes an end cap 50 positioned at least one end thereof. As shown in FIGS. 2 and 4, the end caps 50 extend perpendicularly from the longitudinal dimension of the side rails so as to define a mounting surface 51 suitable for connection to conventional headboards and footboards. The term "conventional" refers to headboards and footboards conforming to standards published by the well known International Sleep Products Association. The end caps 50 include at least one pair of vertically oriented mounting slots 50*a*, 50*b*. Each slot in the pair lies on a common vertical axis 50*c*. In this preferred embodiment each end cap is provided with two pairs of mounting slots and is integrally formed with the side rails 12. Although a headboard 80 and footboard 82 are shown in dotted line in FIG. 1, a headboard 80 may be used alone without the footboard 82.

If desired a decorative cover 54 is provided and snaps into place in the mounting slots 50*a*, 50*b* as needed. These covers 54 provide a finished appearance if no headboard and/or no footboard will be used with the bed frame.

Figure 7:
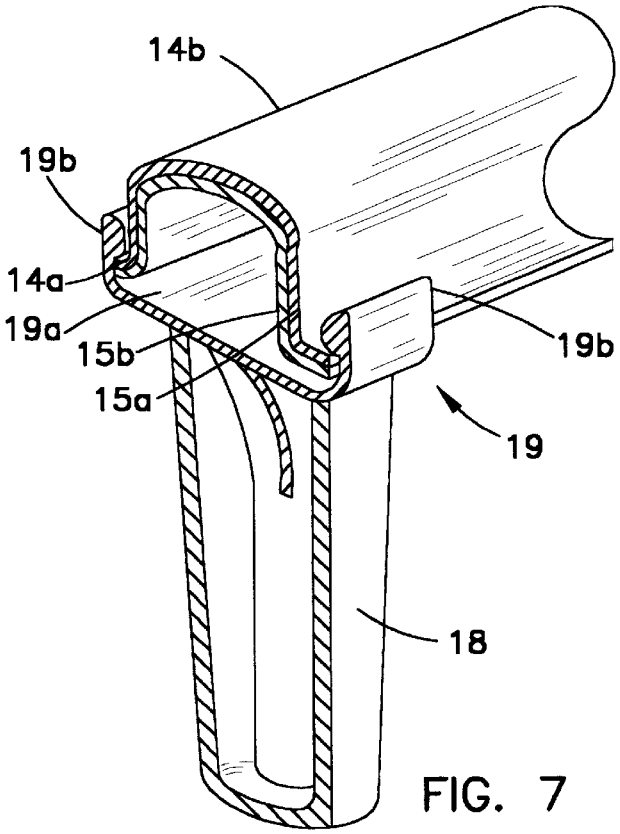
FIG. 7 is a partial cross-sectional perspective view taken along 7—7 in FIG. 5 showing the nesting relationship between the pair of separable elongated slat portions of the present invention.
Figure 8:
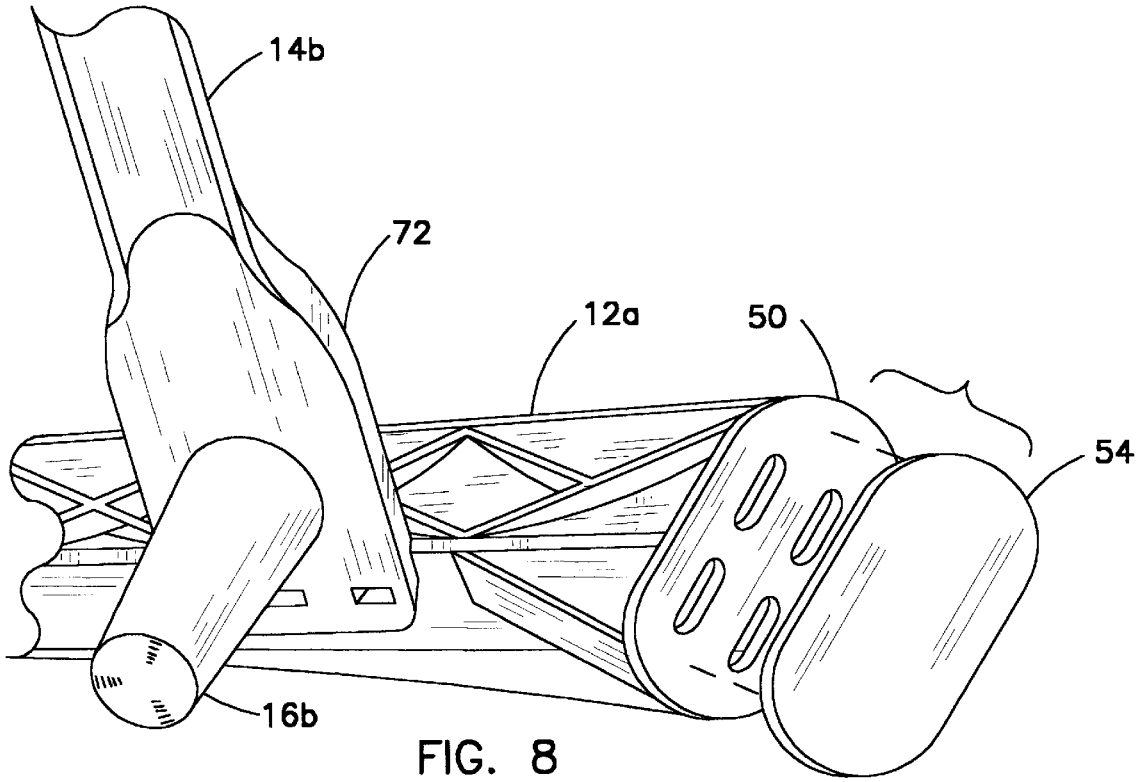
FIG. 8 is a partial perspective view taken from the underside of the connection between the length adjustable slat and the side rail of the present invention.
Figure 9:
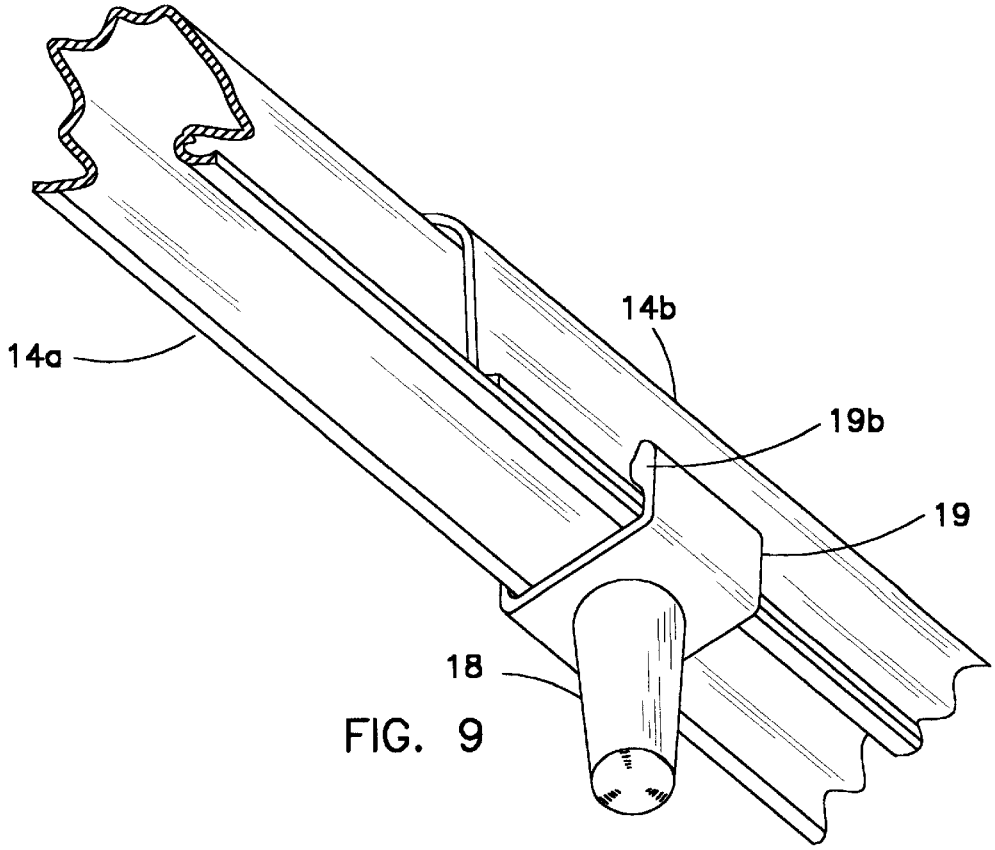
FIG. 9 is a partial cutaway perspective view taken from underneath the length adjustable slat of the present invention showing the connection of the additional support put thereto.
Figure 10:
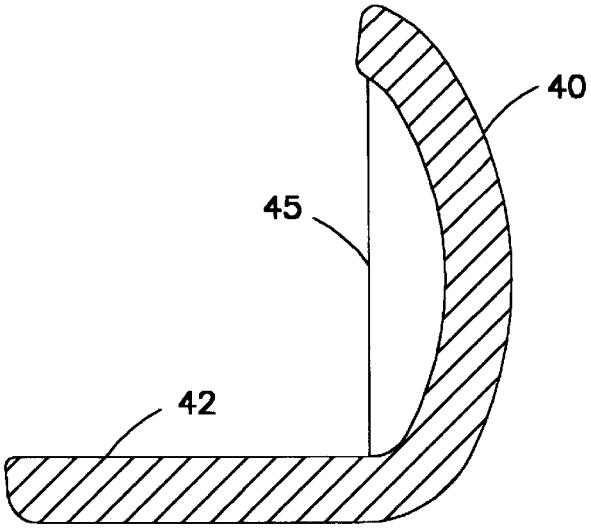
FIG. 10 is a cross-sectional view taken along line 10—10 in FIG. 1 showing the cross-sectional profile of either the male or female members of the length adjustable side rail of the present invention at a point outside either one of the inwardly or outwardly offset meeting sections of those members.

Referring now to FIGS. 1, 5, 7 and 9, the length adjustable slats 14 include first and second elongated U-shaped slat portions 14*a*, 14*b* each of which has a U-shaped first end 70 and a flat second end 72. The U-shaped first ends have a nesting relationship such that the U-shaped end of slat portion 14*a* is received within the slightly larger and corresponding U-shaped second slat portion 14*b*. The smaller of the two slat portions may include with stiffening members to provide additional strength to the bed frame. Each of the slat portions includes laterally projecting flanges 15*a*, 15*b* (FIG. 7). It will be readily appreciated from FIG. 7, that, when the slat portions 14*a*, 14*b* are in a nested position, the horizontally projecting flanges are stacked atop each other vertically. Desirably, each slat portion 14*a*, 14*b* is formed from a single piece of polymeric material so that a smooth, continuous transition is made from the U-shaped end 70 to the flat end 72.

Each slat portion further includes an integrally formed downwardly extending support leg 16*b*. Each support leg 16*b* extends from the flat end 70 of each slat portion and, desirably, is positioned inboard of the outside edge of the slat. The term "inboard" refers to a spacing between the outside edge of the slat and the center line of support foot of between about 2 inches and about 6 inches, preferably between about 3 inches and about 5 inches. It is believed that this positioning increases the resistance of the bed frame assembly to "racking." This term refers to the tendency of the bed frame to sway or tilt responsive to the application of a sideways, horizontal force.

The portion of the slat flat end 70 positioned between the support foot and the outside edge of the slat is recessed. As best illustrated in FIG. 3, the depth of this recess 17 is such that the side rail 12 may be received therein so as to position the horizontal support ledges 32,42 of the male side rail members 12*a*, 12*b* in the same plane as the upper surface 14*c* of the slat. The slat flat end provides a wide-load bearing area for carrying the weight of the mattress and box spring supported by the bed frame.

Figure 5:
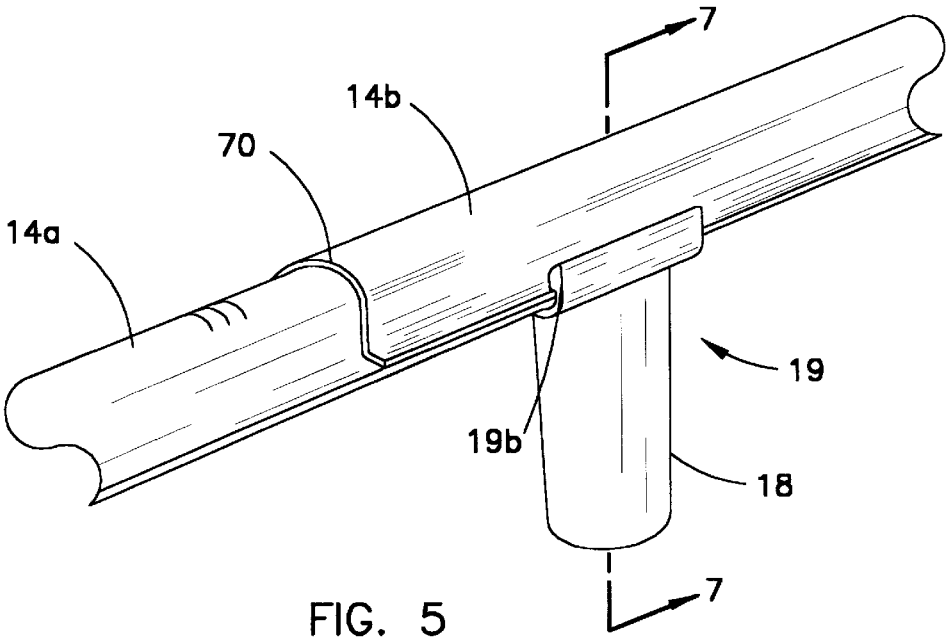
FIG. 5 is a partial perspective view showing the details of the connection of the additional support foot to the pair of separable elongated slat portions of the present invention.

The length adjustable slat further includes a third support foot that clamps the slat portions 14*a*, 14*b* to each other securely at a point between the first and second integrally formed support feet 16*b*. As illustrated in FIG. 5, the third support foot 18 includes an anchoring portion 19 which is secured to the horizontally extending flanges 15*a*, 15*b* of each slat portion. In this preferred embodiment the anchoring portion includes a flat platform 19*a* on either side of which are provided upwardly extending lugs 19*b* whose function is to grip and hold the horizontally extending flanges 15*a*, 15*b* in place.

Assembling the length adjustable slat for a particular size mattress/box spring combination is straightforward and does not require tools. First, the slat portions 14*a*, 14*b* are nested together so as to define a width corresponding to the mattress size, i.e., full, queen, or king. This step may be facilitated by the provision of indicia 22 (See FIG. 1.) on the upper surface 14*c* of the innermost slat portion 14*a*. Next, one of the anchoring lugs 19*b* is fitted onto one set of the horizontally extending flanges 15*a*, 15*b*. The support foot is then rotated under the slat so that the opposing lug 19*b* snaps into place on the opposing horizontally extending flanges 15*a*, 15*b*. It will be appreciated that, given the resiliency of the all polymeric construction of the bed frame, the lugs 19*b* will spread slightly as needed to fit over the stacked flanges 15*a*, 15*b*.

The connection of the side rails 12*a*, 12*b* to the slats 14 is illustrated in FIGS. 2–4. As discussed above, each slat end section 72 includes a recess 17 located near the outside edge of each slat portion. It will be appreciated that, when the male side rail member 12*a* is received in the female side rail member 12*b*, the corresponding horizontal support ledges 32,42 of each member are stacked one atop the other and define a combined thickness substantially equal to the depth of recess 17. However, it will be further appreciated that, for the slats connected closest to the ends of the side rails 12, the thickness of the support ledges equals the depth of the recess. The relative position between the two side rail members is then adjusted such that the fastener openings 36, 46 of each are aligned so as to create a desired length side rail. The thus aligned side rail members 12*a*, 12*b* are then positioned in the recess 17 such that at least two of the fastener openings in the side rail are lined with at least two of the fastener openings in the slat portion flat end. The side rail is then secured to the slat with fasteners 20. In a one preferred polymeric "push-in" fasteners are used. Desirably, at least two fasteners per connection are used although the scope of the present invention includes using a larger or smaller number of fasteners. In an alternative embodiment, the fastener may be molded integrally as part of either the male or female side rail members 12*a*, 12*b*. It will be appreciated that the procedure just described for connecting the slats 14 to the side rails 12 applies to the center slat as illustrated in FIG. 3. Referring to FIGS. 2 and 4, the slats positioned near the first or second ends of the side rails 12 will be connected using a similar approach.

As discussed above, each of the components of the bed frame of the present invention is comprised of a polymeric material. Desirably, these components may be constructed using known thermoplastic manufacturing techniques to include injection molding. Suitable polymeric materials include thermoplastics including polyethylene, polyethylene copolymers, polypropylene, polypropylene copolymers, polystyrene, polystyrene copolymers, styrene acrylonitrile copolymers, polycarbonate and polycarbonate blends. A particularly preferred material is acrylonitrile butadiene styrene (ABS). ABS has high rigidity and impact strength and excellent abrasion resistance. ABS combines toughness with stress-cracking and creep resistance and may be thermoformed with excellent mold detail with most known equipment.

The bed frame system of the present invention offers a number of advantages over known metal bed frame systems and plastic bed frame systems. First, the system uses a single set of components that cooperate so as to be length and width adjustable and thus configurable to accommodate mattress/box spring sets that range in size from double to king. It follows that a bedding retailer need not worry about maintaining an expensive inventory of complete sets of different-sized bed frame components. This is because individual components may be ordered on as-needed basis to make up a complete set.

Another advantage stems from the all-polymeric construction of the bed frame. This construction offers substantial weight saving which reduces shipping costs while providing the structural integrity of known metal bed frame systems. In fact, it is believed that the strength of a properly engineered all-polymeric bed frame system according to the present invention will have the physical characteristics approaching or exceeding that of known metal bed frame systems.

Another advantage lies in the cost savings when bed frames according to the present invention are shipped in a knocked-down condition using known package shippers such as United Parcel Service®. In a preferred embodiment the length of the side rail male and female members 12*a*, 12*b* is between about 40 inches and about 48 inches. The length of each slat portion 14*a*, 14*b* is between about 40 inches and about 48 inches. Each of these dimensions are within the maximum allowable to permit the bed frame assembly to be shipped by UPS without an expensive surcharge. Shippers must pay more to ship conventional metal bed frame systems in this fashion because the components making up those systems typically require a surcharge given the length of their components. The benefits of this situation are numerous. First, if a bedding retailer needs a single bed frame assembly, the single assembly may be shipped overnight on demand at a cost competitive price. Conversely, with known metal bed frame systems, shipping a single unit has proven to be impractical. This because of the high minimum charge for a common carrier and the high extra fees associated with regular parcel shippers. It follows that a retailer must stock a large number of complete metal bed frame systems and thus tie up valuable resources in inventory that may not match demand at a given point in time.

It should be noted that even if the bed frame system of the present invention is shipped via common carrier, its preferred maximum dimension of 48 inches corresponds to the 48 inch standard pallet size used by common carriers.

Another substantial advantage of the all polymeric bed frame system according to the current invention is the substantial weight savings over an all-metal bed frame design. Polymeric components can be engineered to provide strength characteristics that meet or exceed those of all metal bed frames at potentially substantial weight savings. This advantage permits bed frames according to the present invention to be shipped at lower cost and enables the bed frames to be handled with ease during set up.

Yet another advantage lies in the ability to readily incorporate color into a bed frame assembly. Known metal bed frames are nearly universally provided in a dark brown or near black color. The typical paint finish is not of high quality and has proven to be prone to damage during shipment, thus detracting from the appearance of the frame. The bare exposed metal resulting from this damage is susceptible to rust. Consequently, consumers go to great lengths to hide plain metal frames with bed coverings. On the other hand, a wide variety of colorants may be added to the polymeric material used to make the bed frame assembly of the present invention is created. Thus, the bed frame may be color coordinated with the decor in a given room. The bed frame of the present invention is free of rust problems.

A potentially significant safety issue with metal bed frames lies in the sharp edges usually found on the metal frame side rails. Consumers have suffered scrapes and cut from the sharp edges which often are hidden beneath bed covers. Moreover, metal bed frame components are know to pinch fingers and cause cuts during assembly. The rounded parts of the bed frame of the present invention avoid those problems.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What we claim is:

1. An all polymeric bed frame, comprising:

a. opposing laterally spaced apart, elongated side rails, each of said side rails having first and second ends and comprised of a substantially vertical wall and a horizontal support ledge extending laterally from a lower edge of said substantially vertical wall, b. an end cap positioned on at least one of said side rail first or second ends, said end caps adapted for connection to a conventional bed headboard, said end cap being positioned substantially perpendicular to the longitudinal dimension of said side rails;

c. at least two spaced apart slats supported by said horizontal support members between said side rail first and second ends; and d. wherein said side rails and said at least two slats are comprised of a polymeric material selected from the group consisting of polyethylene, polyethylene copolymers, polypropylene, and acrylonitrile butadiene styrene.

2. A bed frame according to claim 1 wherein said side rail vertical walls have a curvilinear shape.

3. A bed frame according to claim 2 wherein said curvilinear vertical walls further include a plurality of stiffening members positioned inside the curved portion of said side walls.

4. A bed frame according to claim 1 wherein said side rail horizontal support ledges are adapted for connection to a bed slat at spaced apart points along the length of said horizontal support ledge.

5. A bed frame according to claim 1 wherein said at least one end cap includes at least one pair of vertically oriented mounting slots, said mounting slots lying on a common vertical axis.

6. A bed frame according to claim 1 wherein each of said at least two spaced apart slats is length adjustable and comprises:

a. a pair of separable elongated slat portions, each slat portion of said pair having a U-shaped body portion and a substantially flat end section, said body portions having a nesting relationship such that one of said pair is received in the other of said pair;

b. a support foot projecting downwardly from each of said substantially flat end sections, each of said support feet formed integrally with said end sections and located inboard of the outside edge of said end sections; and c. an additional support foot secured to said pair of elongated slat portions at a point between said integral support feet wherein said additional support foot includes an anchoring member for securing said first U-shaped body portions to each other.

7. A bed frame according to claim 6 wherein each of said U-shaped body portions further comprise horizontally projecting flanges such that when said U-shaped portions are in said nested relationship said projecting flanges are stacked vertically.

8. A bed frame according to claim 7 wherein said additional support foot further includes a horizontal platform positioned atop said support foot and a pair of lugs secured to opposing sides of said platform said lugs adapted for attachment to said horizontally projecting flanges.

9. A bed frame according to claim 1 wherein each of said side rails is comprised of separable male and female members and i. wherein said male member further includes a first wall thickness and an inwardly offset mating section positioned at one end thereof, said male mating section comprised of a recessed portion of said vertical wall having a second wall thickness less than that of said first wall thickness, said recessed portion being offset from an outside edge of said vertical wall; and ii. wherein said female member further includes a first wall thickness and an outwardly offset mating section positioned at one end thereof and adapted for receiving said male member recessed mating portion therein, said female mating section comprised of a recessed portion of said vertical wall having a second wall thickness less than that of said first wall thickness, said recessed portion being offset from an inside edge of said vertical wall.

10. A bed frame according to claim 9 wherein said male and female side rail members each have a length of not more than 48 inches.

11. An all polymeric bed frame, adjustable in lengthwise and widthwise directions comprising:

a. opposing laterally spaced apart side rails each of said side rails having first and second ends for connection to at least a conventional headboard and being length adjustable;

b. at least two spaced apart slats attached to said adjustable side rails between said first and second ends thereof, said slats being length adjustable;

c. wherein said side rails and said at least two slats are comprised of a polymeric material.

12. A bed frame according to claim 11 further comprising an additional length adjustable slat attached to said opposing side rails and being positioned between said at least two length adjustable slats.

13. A bed frame according to claim 12 wherein each of said length adjustable side rails further includes an end cap mounted at one end of said side rails said end cap having at least one pair of vertically oriented mounting slots, said mounting slots lying on a common vertical axis.

14. A bed frame according to claim 11 wherein said length adjustable side rails comprise:

i. a male member having a generally L-shaped cross section comprised of a substantially vertical wall having a first wall thickness, a horizontal support ledge extending laterally from a lower edge of said vertical wall;

ii. wherein said male member further includes an inwardly offset mating section positioned at one end thereof, said male mating section comprised of a recessed portion of said vertical wall having a second wall thickness less than that of said first wall thickness, said recessed portion being offset from an outside edge of said vertical wall;

iii. a female member having a generally L-shaped cross section comprised of a substantially vertical wall and a horizontal support ledge extending laterally from a lower edge of said vertical wall; and iv. wherein said female member further includes a outwardly offset mating section positioned at one end thereof and adapted for receiving said male member recessed mating portion therein, said female mating section comprised of a recessed portion of said vertical wall having a second wall thickness less than that of said first wall thickness, said recessed portion being offset from an inside edge of said vertical wall.

15. A bed frame according to claim 14 further comprising i. a longitudinal alignment slot formed in said substantially vertical wall of one of said male or female members, said alignment slot extending the length of said male or female recessed mating section;

ii. an alignment rib extending laterally from said substantially vertical wall of one of said male or female members, said alignment rib extending the length of said male or female recessed mating section;

iii. wherein said alignment rib is positioned for engagement with said alignment slot when said male member is received by said female member.

16. A bed frame according to claim 15 wherein said side rail vertical walls have a curvilinear shape.

17. A bed frame according to claim 14 wherein said side rail support ledges further include a plurality of fastener openings, said openings adapted to be aligned in a plurality of combinations so as to relatively position said male and female side rails to accommodate a plurality of mattress lengths.

18. A bed frame according to claim 14 wherein each of said at least two length adjustable slats comprise:

i. a pair of separable elongated slat portions, each slat portion of said pair having a U-shaped body portion and a substantially flat end section, said body portions having a nesting relationship such that one of said pair is received inside the other of said pair;

ii. a support foot projecting downwardly from each of said substantially flat end sections, each of said support feet formed integrally with said end sections and located inboard of the outside edge of said end sections; and iii. an additional support foot secured to said pair of elongated slat portions at a point between said integral support feet wherein said additional support foot includes anchoring lugs for securing said first U-shaped body portions in said nesting relationship.

19. A bed frame according to claim 18 wherein said support feet are formed integrally with said slat portion end sections.

20. A bed frame according to claim 18 wherein said support feet are formed separately from said slat portion end sections and are secured thereto.

21. A bed frame according to claim 18 wherein each of said U-shaped body portions further comprise horizontally projecting flanges such that when said U-shaped portions are in said nested relationship said projecting flanges are stacked vertically.

22. A bed frame according to claim 21 wherein said additional support foot anchoring lugs are secured to said horizontally projecting flanges.

23. A bed frame according to claim 22 wherein said polymeric material is comprised of a material selected from the group consisting of polyethylene, polyethylene copolymers, polypropylene, and acrylonitrile butadiene styrene.

24. An all polymeric length adjustable side rail for beds comprising:

a. a male member having a generally L-shaped cross section comprised of a substantially vertical wall having a first wall thickness, a horizontal support ledge extending laterally from a lower edge of said vertical wall;

b. wherein said male member further includes an inwardly offset mating section positioned at one end thereof, said male mating section comprised of a recessed portion of said vertical wall having a second wall thickness less than that of said first wall thickness, said recessed portion being offset from an outside edge of said vertical wall;

c. a female member having a generally L-shaped cross section comprised of a substantially vertical wall having a first wall thickness and a horizontal support ledge extending laterally from a lower edge of said vertical wall; and d. wherein said female member further includes a outwardly offset mating section positioned at one end thereof and adapted for receiving said male member recessed mating portion therein, said female mating section comprised of a recessed portion of said vertical wall having a second wall thickness less than that of said first wall thickness, said recessed portion being offset from an inside edge of said vertical wall.

25. A side rail according to claim 24 further comprising i. a longitudinal alignment slot formed in said substantially vertical wall of one of said male or female members, said alignment slot extending the length of said male or female recessed mating section;

ii. an alignment rib extending laterally from said substantially vertical wall of one of said male or female members, said alignment rib extending the length of said male or female recessed mating section;

iii. wherein said alignment rib is positioned for engagement with said alignment slot when said male member is received by said female member.

26. A side rail according to claim 25 wherein said side rail support ledges further include a plurality of fastener openings, said openings adapted to be aligned in a plurality of combinations so as to relatively position said male and female side rails to accommodate a plurality of mattress lengths.

27. A side rail according to claim 26 wherein said side rail vertical walls have a curvilinear shape.

28. A side rail according to claim 27 wherein said curvilinear vertical walls further include a plurality of stiffening members.

29. A side rail according to claim 25 wherein the length of said male and female members does not exceed 48 inches.

30. A side rail according to claim 25 further comprising alignment indicia positioned on one of said male or female members, said alignment indicia corresponding to relative positions of said male and female members corresponding to standard mattress sizes.

31. An all polymeric length adjustable bed slat comprising:

a. a pair of separable elongated slat portions, each slat portion of said pair having a U-shaped body portion and a substantially flat end section, said body portions having a nesting relationship such that one of said pair is received inside the other of said pair;

b. a support foot projecting downwardly from each of said substantially flat end sections, each of said support feet formed integrally with said end sections and located inboard of the outside edge of said end sections; and c. an additional support foot secured to said pair of elongated slat portions at a point between said integral support feet wherein said additional support foot includes anchoring lugs for securing said first U-shaped body portions in said nesting relationship.

32. An adjustable bed slat according to claim 31 wherein each of said U-shaped body portions further comprise horizontally projecting flanges such that when said U-shaped portions are in said nested relationship said projecting flanges are stacked vertically.

33. An adjustable bed slat according to claim 31 wherein said additional support foot anchoring lugs are secured to said horizontally projecting flanges.

34. An adjustable bed slat according to claim 31 wherein each of said slat portion end sections further comprises a recessed mounting surface formed therein for receiving a bed frame side rail such that when a bed rail is positioned on said recessed mounting surface the upper surfaces of said slat portions are substantially coplanar with said side rail.

35. An adjustable bed slat according to claim 34 wherein said recessed mounting surface further includes a plurality of fastener openings for receiving a fastener to secure each of said slat portions to a bed side rail.

36. An adjustable bed slat according to claim 31 wherein said downwardly projecting support feet are positioned a distance of between about 2 and about 6 inches inboard of the outside edge of said end sections.

37. A bed frame according to claim 31 wherein said support feet are formed integrally with said slat portion end sections.

38. A bed frame according to claim 31 wherein said support feet are formed separately from said slat portion end sections and are secured thereto.

* * * * *